US007600704B2

(12) United States Patent
Maruhata

(10) Patent No.: US 7,600,704 B2
(45) Date of Patent: Oct. 13, 2009

(54) PULP CRUSHING APPARATUS

(75) Inventor: Kazuya Maruhata, Mima-gun (JP)

(73) Assignee: Livedo Corporation, Ehime (JP)

( * ) Notice: Subject to any disclaimer, the term of this patent is extended or adjusted under 35 U.S.C. 154(b) by 423 days.

(21) Appl. No.: 11/587,942

(22) PCT Filed: Aug. 10, 2005

(86) PCT No.: PCT/JP2005/014959

§ 371 (c)(1),
(2), (4) Date: Oct. 27, 2006

(87) PCT Pub. No.: WO2006/019100

PCT Pub. Date: Feb. 23, 2006

(65) Prior Publication Data

US 2007/0227679 A1 Oct. 4, 2007

(30) Foreign Application Priority Data

Aug. 17, 2004 (JP) ..... P2004-237024
Apr. 28, 2005 (JP) ..... P2005-130818

(51) Int. Cl.
*B02C 18/16* (2006.01)

(52) U.S. Cl. ..... 241/34; 241/36; 241/222; 241/242

(58) Field of Classification Search ..... 241/222–225, 241/34, 36, 235, 236, 189.1, 187, 242
See application file for complete search history.

(56) References Cited

U.S. PATENT DOCUMENTS

| | | | | |
|---|---|---|---|---|
| 2,292,901 | A * | 8/1942 | Schmitz, Jr. | 241/30 |
| 2,890,493 | A * | 6/1959 | Clark | 19/65 R |
| 4,064,599 | A | 12/1977 | Neuenschwander | |
| 4,241,881 | A | 12/1980 | Laumer | |
| 4,764,325 | A | 8/1988 | Angstadt | |

FOREIGN PATENT DOCUMENTS

| | | |
|---|---|---|
| JP | 52-15606 | 2/1977 |
| JP | 56-101961 | 8/1981 |
| JP | 63-59465 | 3/1988 |
| JP | 2001-309945 | 11/2001 |

* cited by examiner

*Primary Examiner*—Mark Rosenbaum
(74) *Attorney, Agent, or Firm*—Wenderoth, Lind & Ponack, L.L.P.

(57) ABSTRACT

An absorbent product manufacturing apparatus including a pulp feed mechanism (2) for feeding a pulp sheet along a lower surface of a pulp guide part (2411) and a pulp crushing mechanism (3) for crushing the pulp sheet from the pulp feed mechanism (2). The pulp crushing mechanism (3) crushes the pulp sheet with a first crushing cylinder (312) and a second crushing cylinder (322). The crushing cylinders are disposed so as to be inclined with respect to a direction of feeding the pulp sheet. This reduces the force necessary to draw the pulp sheet in the feeding direction and suppresses an increase in the movement speed of the pulp sheet in crushing a rear end portion of the pulp sheet. As a result, it is possible to increase the amount of crushed pulp to be generated in a unit time and to maintain uniformity in the quality thereof.

11 Claims, 6 Drawing Sheets

PULP CRUSHING APPARATUS

BACKGROUND OF THE INVENTION

1. Technical Field

The present invention relates to a pulp crushing apparatus for crushing a pulp sheet for absorbent product.

2. Description of the Related Art

In manufacturing absorbent products used for hygiene products such as a disposal diaper, conventionally, a crushing apparatus for crushing a pulp sheet is used. Japanese Patent Application Laid Open Gazette No. 2001-309945, for example, discloses a technique to form an absorbent layer of an absorbent product, where a pulp sheet wound on a drum is unreeled and crushed by a crushing apparatus and the crushed pulp is blown on nonwoven fabrics to be layered. In such a crushing apparatus, for crushing pulp sheets, usually, a feed mechanism such as a feed roller feeds the pulp sheets at a constant speed to a crushing cutter which rotates about a rotation axis where the rotation axis is provided in parallel to the pulp sheets and it is orthogonal to a direction of feeding the pulp sheets.

In such a crushing apparatus, however, there is a possibility that a piece of pulp after passing the feed roller might be pulled by and get entangled in the crushing cutter in crushing a rear end portion of the fed pulp sheet, to go in a crushing chamber provided with the crushing cutter, without being crushed. Even if no piece of pulp gets entangled, the movement speed of pulp sheets increases with torque of the crushing cutter and this makes the amount of crushed pulp to be generated in a unit time larger than the regular amount and makes the crushed pulp coarser. Further, since the distance between a rear end portion of a preceding pulp sheet and a following pulp sheet becomes larger for a certain interval and no crushed pulp is generated for the interval, there arises variation in the amount of crushed pulp to be generated in a unit time and quality thereof, and therefore the uniformity in quality of an absorbent product to be formed is disadvantageously degraded.

For this reason, an operation of stopping the apparatus before entangling the rear end portion of the pulp sheet to remove it from the feed roller is needed and this decreases the efficiency of crushing operation and makes improvement in yield difficult. With two pulp feed mechanisms alternately working, a decrease in efficiency of the crushing operation can be prevented but the apparatus disadvantageously becomes larger.

The coarsely crushed pulp is repeatedly crushed until it becomes smaller than a predetermined size by providing a screen with a lot of very small openings at an outlet of the crushing chamber for discharging the crushed pulp and another crushing mechanism in the crushing chamber, or a full stop of generation of the crushed pulp is prevented by parallelly using a crushing apparatus for crushing a pulp sheet coarsely and another crushing apparatus for crushing a pulp sheet finely. These methods, however, can not keep a constant amount of crushed pulp to be generated in a unit time and thereby need measurement for the amount of crushed pulp before formation of an absorbent product.

SUMMARY OF THE INVENTION

The present invention is intended for a pulp crushing apparatus for crushing a pulp sheet for absorbent product, and it is an object of the present invention to increase in the amount of crushed pulp to be generated in a unit time and uniformity of quality thereof by suppressing an increase in movement speed of a pulp sheet in crushing a near-rearend portion of the pulp sheet after passing a pulp feed mechanism.

According to the present invention, the pulp crushing apparatus comprises a pulp feed mechanism for feeding a pulp sheet along a predetermined feed line, and a first crushing mechanism and a second crushing mechanism for crushing one end and the other end of the pulp sheet, respectively, with respect to a width direction of the pulp sheet, the first crushing mechanism and the second crushing mechanism being arranged in parallel to the width direction in the downstream of the pulp feed mechanism, and in the pulp crushing apparatus of the present invention, each of the first crushing mechanism and the second crushing mechanism comprises an inclined rotation axis, farther end of which from a center line of the feed line is inclined toward the pulp feed mechanism, a crushing cylinder having a substantial tubular shape with the inclined rotation axis as a center and rotating about the inclined rotation axis to crush the pulp sheet which goes into an outer peripheral surface thereof, and a pulp support part having a substantial plate shape, for supporting the pulp sheet against rotation of the outer peripheral surface.

The pulp crushing apparatus of the present invention can increase the amount of crushed pulp to be generated in a unit time and uniformity of quality thereof by suppressing an increase in movement speed of the pulp sheet in crushing a near-rearend portion of the pulp sheet.

According to one preferred embodiment of the present invention, the respective crushing cylinders of the first crushing mechanism and the second crushing mechanism are provided, being approximate to each other and symmetrical with respect to the center line of the feed line, and the pulp sheet is crushed in whole in the width direction thereof by the first crushing mechanism and the second crushing mechanism. Preferably, an angle between the inclined rotation axis of the crushing cylinder and the center line of the feed line is not smaller than 30 degrees and not larger than 60 degrees.

According to another preferred embodiment of the present invention, the crushing cylinder comprises a plurality of crushing blades arranged along the inclined rotation axis, each of the plurality of crushing blades has a substantial disk shape orthogonal to the inclined rotation axis, and comprises a plurality of teeth provided in its outer periphery at a regular pitch, and teeth are arranged in a spiral fashion on the outer peripheral surface of the crushing cylinder. It is thereby possible to reduce the maximum value of a force applied to the pulp sheet by rotation of the crushing cylinder.

Preferably, the teeth of the crushing cylinder sequentially come into contact with the pulp sheet outwards from the side of the center line of the feed line and teeth of the first crushing mechanism and teeth of the second crushing mechanism are provided symmetrically with respect to the center line of the feed line.

According to still another preferred embodiment of the present invention, a near-rearend portion of a preceding pulp sheet after passing the pulp feed mechanism is fed into the first crushing mechanism and the second crushing mechanism with its end pushed by a following pulp sheet fed by the pulp feed mechanism in crushing the near-rearend portion of the preceding pulp sheet. Preferably, each of the first crushing mechanism and the second crushing mechanism further comprises a guide part which comes into contact with the pulp sheet while being opposed to the pulp support part. Since the guide part is provided, it is possible to surely crush the pulp sheet even in crushing the near-rearend portion of the pulp sheet.

According to an aspect of the present invention, the pulp crushing apparatus further comprises a control part for changing a feeding speed at which a pulp sheet is fed by the pulp feed mechanism and controlling a rotation speed of crushing cylinders of the first crushing mechanism and the second crushing mechanism on the basis of the feeding speed. With this control by the control part, it is possible to maintain uniformity in quality of the crushed pulp even if the feeding speed of the pulp sheet varies.

According to another aspect of the present invention, the pulp crushing apparatus further comprises a stopper provided near the center line of the feed line between the first crushing mechanism and the second crushing mechanism, being opposed to a front edge of the pulp sheet.

According to still another aspect of the present invention, the pulp crushing apparatus further comprises a pressing part provided near the center line of the feed line between the first crushing mechanism and the second crushing mechanism, for pressing a front end portion of the pulp sheet onto the pulp support part.

These and other objects, features, aspects and advantages of the present invention will become more apparent from the following detailed description of the present invention when taken in conjunction with the accompanying drawings.

DETAILED DESCRIPTION OF THE INVENTION

Figure 1:
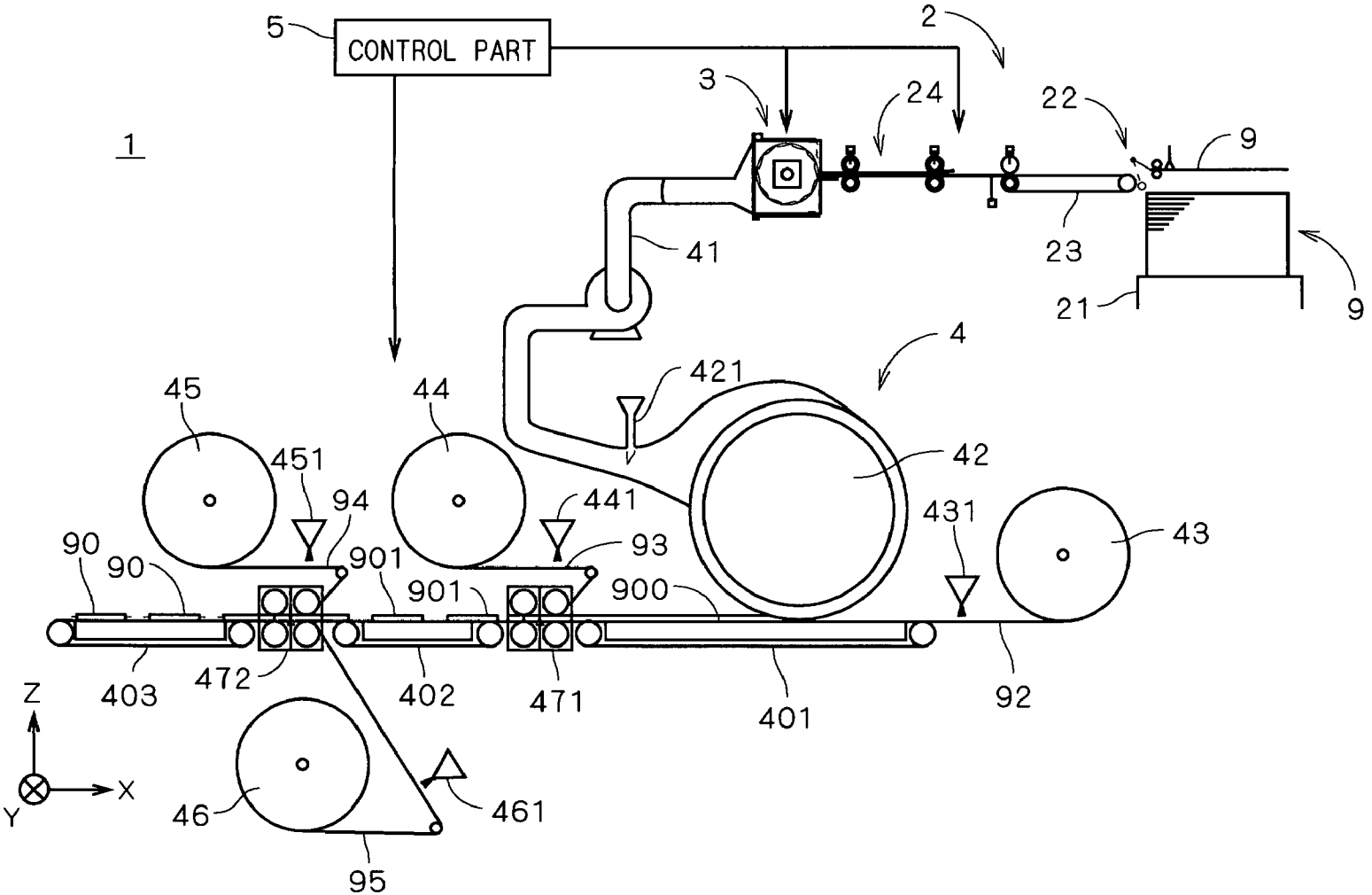
FIG. 1 is a view showing a construction of an absorbent product manufacturing apparatus in accordance with a first preferred embodiment.

FIG. 1 is a view showing a construction of an absorbent product manufacturing apparatus in accordance with the first preferred embodiment of the present invention. The absorbent product manufacturing apparatus 1 serves to manufacture an absorbent product 90 used for a disposal diaper, a sanitary napkin or the like, and the absorbent product 90 is manufactured by using crushed pulp which is obtained by crushing a pulp sheet 9 which is pulp cut into a certain size.

The absorbent product manufacturing apparatus 1 comprises a pulp feed mechanism 2 for feeding the pulp sheet 9 along a predetermined feed line in the (−X) direction of FIG. 1, a pulp crushing mechanism 3 for crushing the pulp sheet 9 fed by the pulp feed mechanism 2 downstream of the pulp feed mechanism 2, an absorbent product forming mechanism 4 for forming the absorbent product 90 by molding the crushed pulp generated by the pulp crushing mechanism 3 and a control part 5 for controlling these mechanisms. In the absorbent product manufacturing apparatus 1, the pulp feed mechanism 2 and the pulp crushing mechanism 3 serve as a pulp crushing apparatus for crushing the pulp sheet 9 for absorbent product.

The pulp feed mechanism 2 comprises a pulp mounting part 21 on which a plurality of layered pulp sheets 9 are placed, a pulp unloading mechanism 22 for unloading the pulp sheet 9 from the pulp mounting part 21 sheet by sheet, a conveyor 23 receiving the pulp sheet 9 from the pulp unloading mechanism 22 to transfer it in the (−X) direction, and a feed line 24 provided on the (−X) side of the conveyor 23, for guiding the pulp sheet 9 to the pulp crushing mechanism 3.

Figure 2:
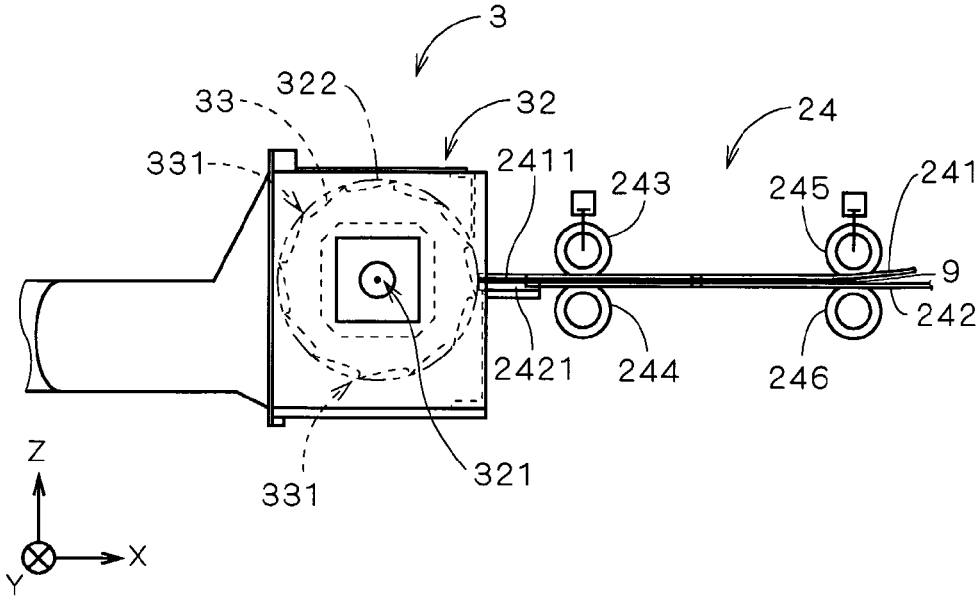
FIG. 2 is an enlarged front elevation showing a feed line and a pulp crushing mechanism and their vicinity.
Figure 3:
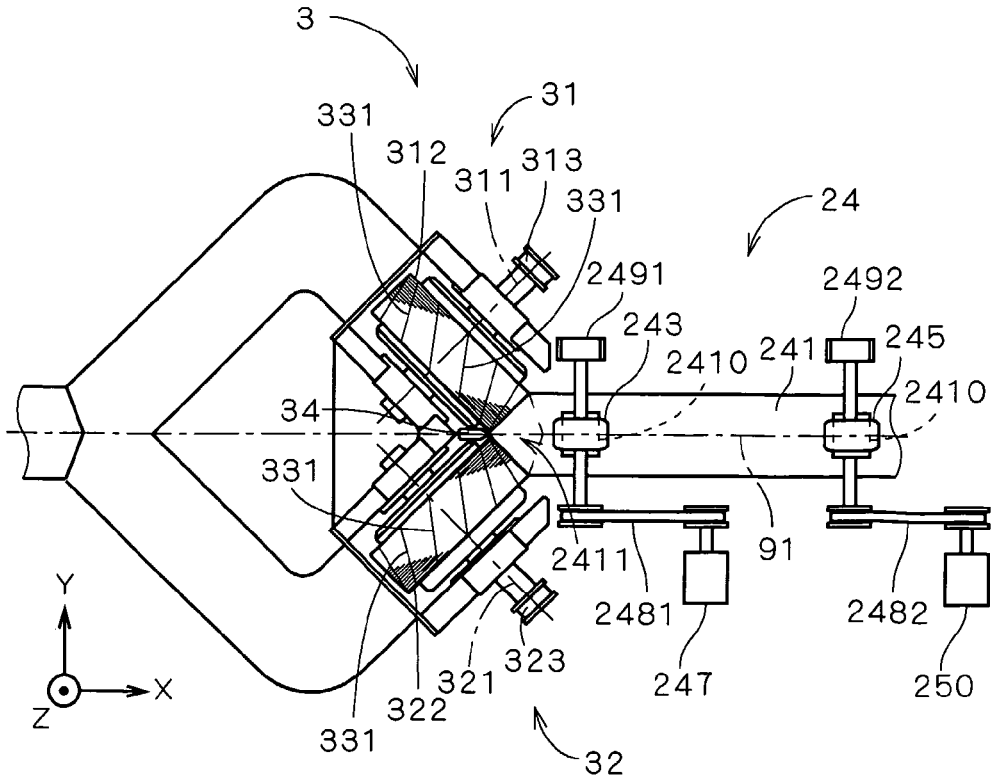
FIG. 3 is an enlarged plan view showing the feed line and the pulp crushing mechanism and their vicinity.

FIGS. 2 and 3 are a front elevation and a plan view, respectively, enlargedly showing the feed line 24 and the pulp crushing mechanism 3 and their vicinity. For convenience of illustration, the direction of showing part of the pulp crushing mechanism (the second crushing mechanism 32) is changed in FIG. 2 (and FIG. 1) and the inside of part of the pulp crushing mechanism (the first crushing mechanism 31 and the second crushing mechanism 32) is shown in FIG. 3 (the same applies to FIGS. 5 and 7).

As shown in FIG. 2, the feed line 24 comprises an upper plate 241 and a lower plate 242 each having a substantial plate shape, which are in contact with main surfaces of the pulp sheet 9 on the (+Z) and (−Z) sides, respectively. The pulp feed mechanism 2 further comprises a first upper roller 243 provided on the (+X) side of the pulp crushing mechanism 3, a first lower roller 244 provided so as to be opposed to the first upper roller 243 with the pulp sheet 9 interposed therebetween, a second upper roller 245 provided on the (+X) side of the first upper roller 243 and a second lower roller 246 provided so as to be opposed to the second upper roller 245 with the pulp sheet 9 interposed therebetween. The first upper roller 243 and the second upper roller 245 are in contact with the main surface of the pulp sheet 9 on the (+Z) side through openings 2410 (see FIG. 3) provided in the upper plate 241. The first lower roller 244 and the second lower roller 246 are in contact with the main surface of the pulp sheet 9 on the (−Z) side through openings provided in the lower plate 242. The first upper roller 243 and the second upper roller 245 are pressed toward the lower rollers by a pressing mechanism.

In the pulp feed mechanism 2, the first upper roller 243 and the second upper roller 245 are rotated clockwise in FIG. 2 by motors 247 and 250 through timing belts 2481 and 2482, respectively. The first lower roller 244 and the second lower roller 246 are connected to the first upper roller 243 and the second upper roller 245 through gears 2491 and 2492 and rotated counterclockwise in FIG. 2 with rotation of the first upper roller 243 and the second upper roller 245, and the pulp sheet 9 is thereby smoothly fed to the pulp crushing mechanism 3, being guided by the upper plate 241 and the lower plate 242, respectively. In the absorbent product manufacturing apparatus 1, an operation of the pulp crushing mechanism 3 is controlled on the basis of the rotation speed of the motor 247 (i.e., the feeding speed of the pulp sheet 9) which is controlled by the control part 5 (detailed discussion on this control will be made later). The first lower roller 244 and the second lower roller 246 may be passively rotated with the movement of the pulp sheet 9.

The pulp crushing mechanism 3 comprises a first crushing mechanism 31 and a second crushing mechanism 32 which are arranged along the width direction of the pulp sheet 9 (the Y direction) as shown in FIG. 3. The first crushing mechanism 31 and the second crushing mechanism 32 crush portions on the (+Y) and (−Y) sides of the pulp sheet 9 on the (+Y) and (−Y) sides of the center line 91 of the feed line 24 in parallel to the direction of feeding the pulp sheet 9 (the X direction).

The first crushing mechanism 31 comprises a first crushing cylinder 312 having a substantial tubular shape with a first inclined rotation axis 311 as a center and rotating about the first inclined rotation axis 311 to crush the pulp sheet 9 which goes into an outer peripheral surface thereof, and the second crushing mechanism 32 comprises a second crushing cylinder 322 having a substantial tubular shape with a second inclined rotation axis 321 as a center and rotating about the second inclined rotation axis 321 to crush the pulp sheet 9 which goes into an outer peripheral surface thereof. The first inclined rotation axis 311 and the second inclined rotation axis 321 are each in parallel to the pulp sheet 9, and each farther end of the inclined rotation axes from the center line 91 of the feed line 24 is inclined toward the pulp feed mechanism 2, i.e., the inclined rotation axis goes toward the pulp feed mechanism 2 (the (+X) side) as become farther from the center line 91. The first inclined rotation axis 311 and the second inclined rotation axis 321 are symmetrical with respect to the center line 91 of the feed line 24, and an angle between each of the inclined rotation axes and the center line 91 is not smaller than 30 degrees and not larger than 60 degrees (45 degrees in this preferred embodiment). In other words, the first crushing cylinder 312 and the second crushing cylinder 322 are provided so as to be inclined with respect to the direction of feeding the pulp sheet 9.

The first crushing cylinder 312 and the second crushing cylinder 322 are provided, being approximate to each other, symmetrically on the (+Y) and (−Y) sides of the center line 91 of the feed line 24 and are rotated clockwise in FIG. 2 by a cylinder rotating mechanism, to crush the whole pulp sheet 9 with respect to the width direction thereof. FIGS. 1 and 2 show the second crushing mechanism 32 from the direction in parallel to the second inclined rotation axis 321 (the same applies to FIG. 5).

As shown in FIGS. 2 and 3, the second crushing cylinder 322 comprises thirty crushing blades 33 arranged along the second inclined rotation axis 321, and each crushing blade 33 has a substantial disk shape with the second inclined rotation axis 321 as a center. Each blade is orthogonal to the second inclined rotation axis 321. Each crushing blade 33 comprises a plurality of teeth 331 (twelve in this preferred embodiment) provided in its outer periphery at a regular pitch. Similarly, the first crushing cylinder 312 comprises thirty crushing blades 33 arranged along the first inclined rotation axis 311, and each crushing blade 33 has a substantial disk shape with the first inclined rotation axis 311 as a center, orthogonal to the first inclined rotation axis 311.

Figure 4:
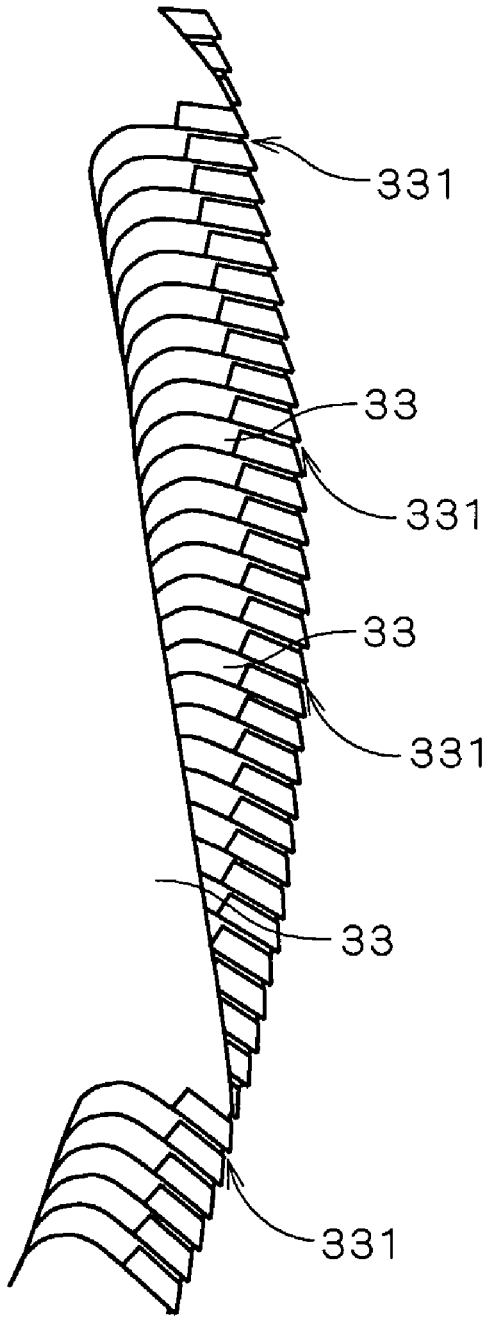
FIG. 4 is an enlarged view showing an outer peripheral surface of a second crushing cylinder and its vicinity.

FIG. 4 is an enlarged view showing an outer peripheral surface of the second crushing cylinder 322 and its vicinity viewed from the direction in parallel to the second inclined rotation axis 321. As shown in FIG. 4, since the thirty crushing blades 33 have the teeth 331 which are so provided as to be shifted by one degree in the rotation direction of the second crushing cylinder 322 (in other words, clockwise in FIG. 4) as become closer to the center line 91 of the feed line 24 (see FIG. 3), tip portions of the teeth 331 are arranged in a spiral fashion with the second inclined rotation axis 321 as a center on the outer peripheral surface of the second crushing cylinder 322 as shown in FIG. 3. Similarly, in the first crushing cylinder 312, tip portions of the teeth 331 are arranged in a spiral fashion with the first inclined rotation axis 311 as a center on the outer peripheral surface of the first crushing cylinder 312, and the teeth 331 of the first crushing cylinder 312 and the teeth 331 of the second crushing cylinder 322 are provided symmetrically on the (+Y) and (−Y) sides of the center line 91 of the feed line 24.

In the pulp crushing mechanism 3, since the first crushing cylinder 312 and the second crushing cylinder 322 are rotated synchronously through a pulley 313 and a pulley 323 and the not-shown timing belts, respectively, the pulp sheet 9 is crushed sequentially by the teeth 331 arranged in a spiral fashion on the outer peripheral surface of these crushing cylinders. Therefore, it is possible to prevent a lot of teeth 331 in these crushing cylinders from coming into contact with the pulp sheet 9 at the same time and thereby reduce the maximum value of a force applied to the pulp sheet 9 in crushing. Since the teeth 331 of these crushing cylinders sequentially come into contact with the pulp sheet 9 outwards from the side of the center line 91 of the feed line 24 (in other words, in the direction of becoming farther away from the center line 91) to crush the pulp sheet 9, it is possible to prevent a force to push and bend the pulp sheet 9 toward the center line 91 and stably crush the pulp sheet 9. Since the teeth 331 of these crushing cylinders come into contact with the pulp sheet 9 symmetrically with respect to the center line 91 to crush the pulp sheet 9, the force applied to the pulp sheet 9 is made symmetrical with respect to the center line 91 and it is thereby possible to prevent the pulp sheet 9 from shifting in the Y direction (the direction orthogonal to the direction of feeding the pulp sheet 9).

In the absorbent product manufacturing apparatus 1, as shown in FIGS. 2 and 3, front edges of the upper plate 241 and the lower plate 242 are positioned approximately at the outer peripheral surface of the first crushing cylinder 312 on the (+Y) side of the center line 91 of the feed line 24 in parallel and approximately at the outer peripheral surface of the second crushing cylinder 322 on the (−Y) side of the center line 91 in parallel. When the first crushing cylinder 312 and the second crushing cylinder 322 are rotated to come into contact with the pulp sheet 9 from the (+Z) side, a tip portion 2421 of the lower plate 242 serves as a support part for supporting the pulp sheet 9, which goes in these crushing cylinders from the (−Z) side, against the rotation of the outer peripheral surfaces of these crushing cylinders, and as a result, the pulp sheet 9 is surely crushed. Hereinafter, the tip portion 2421 of the lower plate 242 is referred to as "a pulp support part 2421".

A tip portion 2411 of the upper plate 241, being opposed to the pulp support part 2421, serves as a guide part to come into contact with the pulp sheet 9 from the (+Z) side. Hereinafter, the tip portion 2411 of the upper plate 241 is referred to as "a pulp guide part 2411". As the pulp support part 2421, two support parts may be provided correspondingly to the first crushing cylinder 312 and the second crushing cylinder 322, and as the pulp guide part 2411, two guide parts may be provided correspondingly to these crushing cylinders.

When crushing of the pulp sheet 9 goes ahead and a rear end portion of the pulp sheet 9 (the edge on the (+X) side) passes the first upper roller 243 and the first lower roller 244 and is released from the pulp feed mechanism 2, the pulp sheet 9 is automatically moved in the feeding direction by a force applied to the pulp sheet 9 (a force to pull the pulp sheet 9 toward the (−X) direction) with rotation of the first crushing cylinder 312 and the second crushing cylinder 322.

In the pulp crushing mechanism 3, as discussed above, since the first crushing cylinder 312 and the second crushing cylinder 322 are provided so as to be inclined with respect to the direction of feeding the pulp sheet 9, a force applied to the pulp sheet 9 in the feeding direction (or the movement speed in the feeding direction) is a component of the force (or the movement speed) applied to the pulp sheet 9 with rotation of these crushing cylinders in the feeding direction. As a result, it is possible to reduce the force required to pull the pulp sheet 9 in the feeding direction (or the movement speed) as compared with the case where the rotation axis of the crushing cylinder is provided orthogonally to the feeding direction, and it is further possible to suppress an increase in movement speed of the pulp sheet 9 in crushing a near-rearend portion of the pulp sheet 9. This suppresses variation in the amount of pulp sheet 9 to be fed to the pulp crushing mechanism 3 in a unit time also at the near-rearend portion of the pulp sheet 9, and it is thereby possible to increase the amount of crushed pulp to be generated in a unit time and uniformity in quality thereof.

Since the pulp sheets 9 are sequentially crushed by the teeth 331 arranged in a spiral fashion on the outer peripheral surfaces of the first crushing cylinder 312 and the second crushing cylinder 322, it is possible to further reduce the force required to pull the pulp sheet 9 in the feeding direction (in other words, prevent a large force from discontinuously applying to the pulp sheet 9) and more efficiently suppress an increase in feeding speed of the pulp sheet 9 in crushing the near-rearend portion of the pulp sheet 9.

The movement speed of the pulp sheet 9 after passing the first upper roller 243 and the first lower roller 244 varies with the kind or thickness of the pulp sheet 9, the arrangement of the first crushing cylinder 312 and the second crushing cylinder 322 or the like. In the pulp crushing mechanism 3, by setting an angle of the first inclined rotation axis 311 and the second inclined rotation axis 321 to the center line 91 to an appropriate one (45 degrees in this preferred embodiment), the movement speed of the pulp sheet 9 after passing the pulp feed mechanism 2 is made lower than the feeding speed of the pulp sheet 9 by the pulp feed mechanism 2. Therefore, in crushing a near-rearend portion of a preceding pulp sheet 9 after passing the pulp feed mechanism 2 (exactly, the first upper roller 243 and the first lower roller 244), the preceding pulp sheet 9 is fed into the pulp crushing mechanism 3 with its rear end portion pushed by a following pulp sheet 9 fed by the pulp feed mechanism 2. In other words, the rear end portion of the preceding pulp sheet 9 after passing the pulp feed mechanism 2 is fed into the pulp crushing mechanism 3 at the same speed as the one before passing the pulp feed mechanism 2 and crushed therein. As a result, the pulp sheets 9 can be always fed at a constant speed by sequentially feeding a plurality of pulp sheets 9 into the pulp crushing mechanism 3, and it is thereby possible to always maintain a uniform amount of crushed pulp to be generated in a unit time.

Since the pulp guide part 2411 and the pulp support part 2421 which come into contact with the pulp sheet 9 from the (+Z) and (−Z) sides are provided closely to the outer peripheral surfaces of these crushing cylinders, even in crushing the rear end portion of the pulp sheet 9, it is possible to prevent the pulp sheet 9, which is separated from the first upper roller 243 and the first lower roller 244, from being drawn into the pulp crushing mechanism 3 without being crushed because of a bend or the like, and each pulp sheet 9 can be surely crushed completely. As a result, it is possible to improve a yield of crushed pulp.

In the pulp crushing mechanism 3, as shown in FIG. 3, since the first crushing cylinder 312 and the second crushing cylinder 322 are provided so as to be inclined with respect to the direction of feeding the pulp sheet 9, a stopper 34 opposed to the front edge of the pulp sheet 9, which is being fed along the feed line 24 and crushed, can be provided between the first crushing mechanism 31 and the second crushing mechanism 32 near the center line 91 of the feed line 24. If the feeding speed of the near-rearend portion of the pulp sheet 9 increases due to some abnormality, the stopper 34 comes into contact with the front edge of the pulp sheet 9 to forcedly reduce the feeding speed. As a result, even if the feeding speed of the pulp sheet 9 varies, it is possible to prevent the crushed pulp generated by the pulp crushing mechanism 3 from becoming too fine and maintaining the uniformity in the quality of the crushed pulp.

In the absorbent product manufacturing apparatus 1, for example, if the supply of the pulp sheets 9 to the pulp mounting part 21 is delayed by some cause, in order to prevent the feed of the pulp sheets 9 into the pulp crushing mechanism 3 from being stopped for a long time, the feeding speed of the pulp sheet 9 may be made slower by reducing the rotation speed of the motors 247 and 250 of the pulp feed mechanism 2. In this case, on the basis of the rotation speed of the motor 247 (in other words, the feeding speed of the pulp sheet 9), the first crushing cylinder 312 of the first crushing mechanism 31 and the second crushing cylinder 322 of the second crushing mechanism 32 are controlled by the control part 5, to reduce the rotation speed of these crushing cylinders. As a result, even if the feeding speed of the pulp sheet 9 varies, without stopping the operation of the absorbent product manufacturing apparatus 1, it is possible to prevent the crushed pulp being generated by the pulp crushing mechanism 3 from becoming too fine and maintaining the uniformity in the quality of the crushed pulp. If the feed of the pulp sheet 9 is delayed, by making the rotation speed of the motor 250 higher than that of the motor 247, the newly fed pulp sheet 9 can catch up with the preceding pulp sheet 9 and therefore the yield of the crushed pulp is improved.

Next, the construction of the absorbent product manufacturing apparatus 1 downstream of the pulp crushing mechanism 3 will be discussed. The crushed pulp generated by the pulp crushing mechanism 3 is transferred to the absorbent product forming mechanism 4 through a duct 41 by a blowing mechanism (not shown) and mixed with a water-absorbent polymer (e.g., SAP (Super Absorbent Polymer)) fed by a polymer feed part 421 to be blown on a tubular adsorption drum 42. The adsorption drum 42 is rotated clockwise in FIG. 1 and absorbs the crushed pulp and the water-absorbent polymer with a suction mechanism (not shown) connected to its inside onto its outer peripheral surface in which very small vacuum holes are provided up to a predetermined level. Depending on the absorbing power required for the absorbent product 90, mixture of the water-absorbent polymer may be omitted.

The crushed pulp and the water-absorbent polymer absorbed on the outer peripheral surface of the adsorption drum 42 are moved toward the (−Z) side of the adsorption drum 42 by rotation of the adsorption drum 42 and then transferred on tissue paper 92 which is unreeled from a roll 43 and conveyed by a conveyor 401 toward the (−X) direction. An adhesive (e.g., hot melt) is applied in advance onto an upper surface of the tissue paper 92 by an adhesive supply part 431 and the crushed pulp and the water-absorbent polymer are bonded on the tissue paper 92 to form a pulp layer 900.

While the pulp layer 900 is transferred by the conveyor 401 toward the (−X) direction, an adhesive is applied onto one side of tissue paper 93 unreeled from another roll 44 by an adhesive supply part 441 and the tissue paper 93 is bonded on the pulp layer 900 and the tissue paper 92 with its one side with adhesive facing the pulp layer 900. The pulp layer 900 wrapped by the tissue paper 92 and 93 from the (−Z) and (+Z) sides, respectively, is cut into pieces 901 (hereinafter, referred to as "absorbent cores 901" since these pieces serve as core parts of the absorbent product 90) each having a predetermined length by a cutting part 471 and a plurality of absorbent cores 901 are transferred by a conveyor 402 toward the (−X) direction at a predetermined pitch.

A top sheet 94 and a back sheet 95 unreeled from rolls 45 and 46, with an adhesive from adhesive supply parts 451 and 461 applied to their respective one side, are bonded on the tissue paper 92 and 93 wrapping the absorbent cores 901 and cut by a cutting part 472 at a gap between the adjacent absorbent cores 901, to form the absorbent product 90. The absorbent product 90 manufactured is unloaded from the absorbent product manufacturing apparatus 1 by a conveyor 403.

In the absorbent product manufacturing apparatus 1, as discussed above, since the amount of crushed pulp to be generated in a unit time and its quality can be increased by the pulp crushing mechanism 3, it is possible to improve the uniformity in quality of the absorbent product 90. If such a control is made as to reduce the feeding speed of the pulp sheet 9 and the rotation speed of the crushing cylinders, an operation speed of the downstream constituents is controlled to decrease in proportion.

Figure 5:
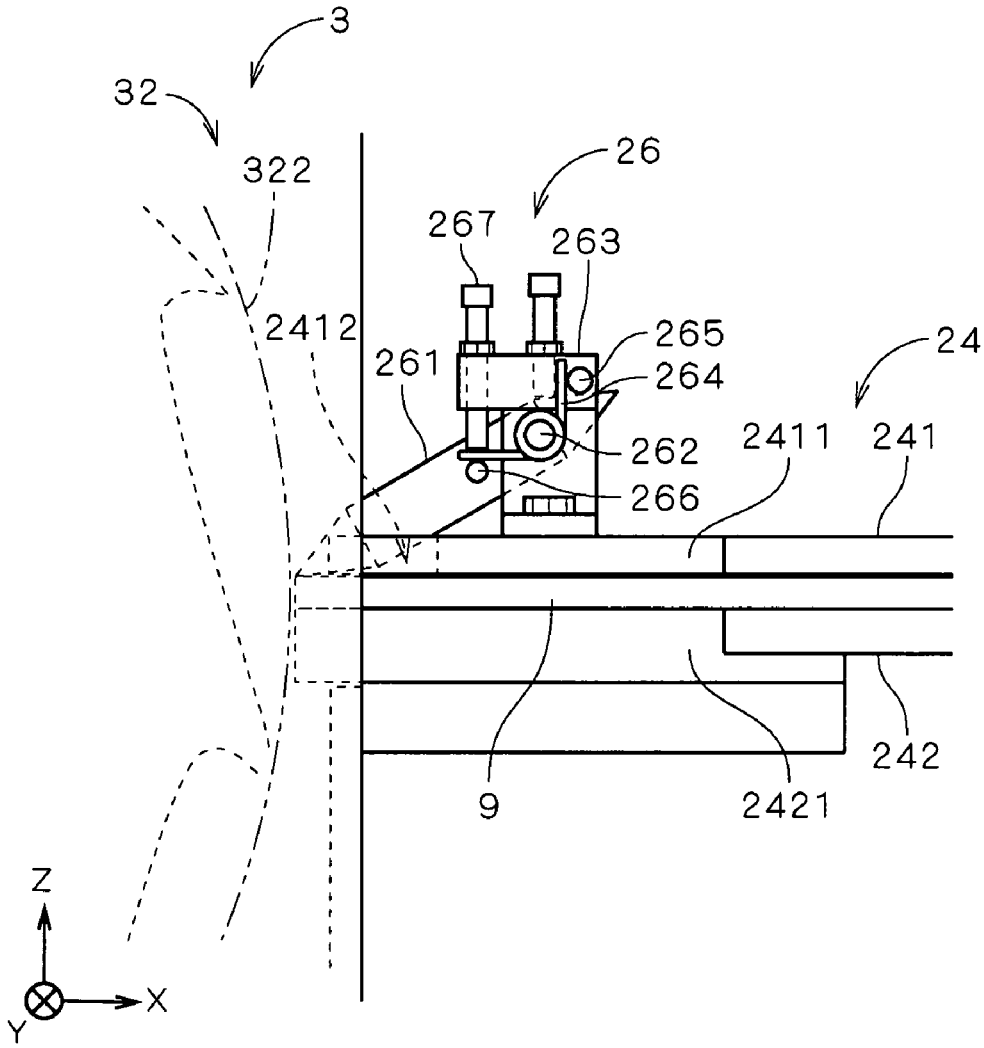
FIG. 5 is an enlarged front elevation showing part of the feed line and the pulp crushing mechanism in a pulp crushing apparatus in accordance with a second preferred embodiment.
Figure 6:
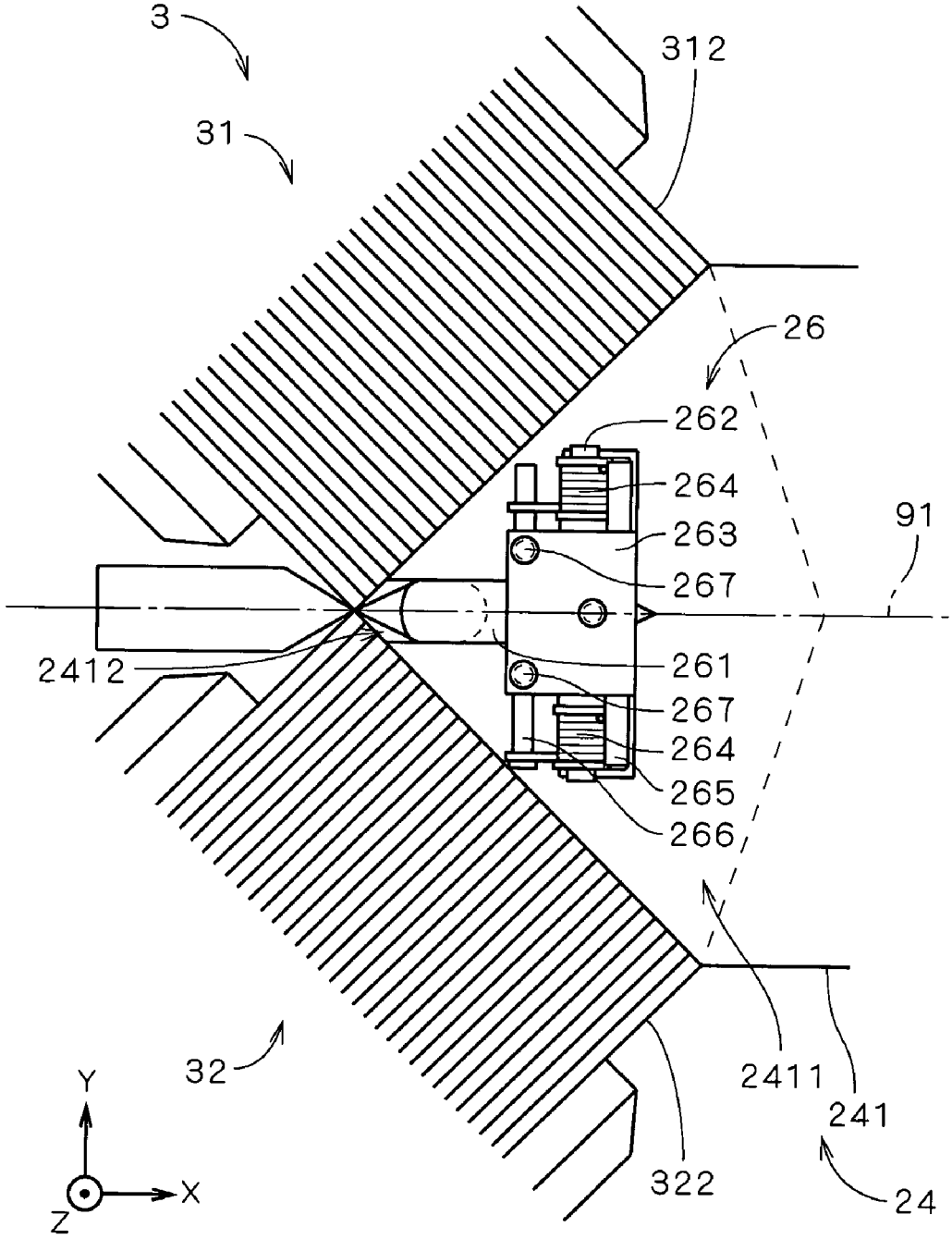
FIG. 6 is an enlarged plan view showing part of the feed line and the pulp crushing mechanism.

Next, a pulp crushing apparatus (a pulp feed mechanism and a pulp crushing mechanism) in accordance with the second preferred embodiment will be discussed. FIGS. 5 and 6 are a front elevation and a plan view, respectively, enlargedly showing part of the feed line 24 and the pulp crushing mechanism 3 in the pulp crushing apparatus in accordance with the second preferred embodiment. In the pulp crushing apparatus of the second preferred embodiment, a pulp pressing mechanism 26 serving as a pressing part for pressing the front end portion of the pulp sheet 9 onto the pulp support part 2421 is provided on the (−X) side of the feed line 24. Constituent elements other than the above are identical to those shown in FIGS. 1 to 4 and are represented by the same reference signs.

As shown in FIGS. 5 and 6, the pulp pressing mechanism 26 is provided between the first crushing mechanism 31 and the second crushing mechanism 32, near the center line 91 of the feed line 24 (on the center line 91 in this preferred embodiment). The pulp pressing mechanism 26 comprises a pressing member 261 having a substantial cylindrical shape and conical ends, and the pressing member 261 is attached to a frame 263, which is rotatable about a rotation axis 262. In the pulp crushing apparatus of the second preferred embodiment, a notch 2412 extending from the end on the (−X) side toward the (+X) side is provided at the pulp guide part 2411 of the upper plate 241 and a tip portion of the pressing member 261 on the (−X) side is inserted into the notch 2412 of the pulp guide part 2411 so as to be opposed to the pulp support part 2421 of the lower plate 242.

In the pulp pressing mechanism 26, torsion springs 264 are attached to the outer periphery of the rotation axis 262 both on the (+Y) and (−Y) sides of the pressing member 261 and the frame 263, and an end portion of each torsion spring 264 protrudes from its coil part toward almost the (+Z) direction and the other end portion protrudes toward almost the (−X) direction. The end portion protruding toward the (+Z) direction is in contact with the (−X) side of an axis 265 protruding from the frame 263 toward the (+Y) and (−Y) directions and the other end portion protruding toward the (−X) direction is in contact with the (+Z) side of an axis 266 protruding from the pressing member 261 toward the (+Y) and (−Y) directions.

Since the torsion springs 264 are compressed in a direction where the end portion in contact with the axis 266 should approximate clockwise in FIG. 5 to the other end portion in contact with the axis 265, the axis 266 is pressed down toward the (−Z) direction by the repulsion of the torsion springs 264. As a result, a force to rotate the pressing member 261 counterclockwise in FIG. 5 about the rotation axis 262 works and front end portion of the pulp sheet 9 (the end portion on the (−X) side) is thereby pressed onto the pulp support part 2421 by the pressing member 261 between the tip portion of the pressing member 261 on the (−X) side and the pulp support part 2421.

Two pins 267 extending in the Z direction are provided on the frame 263 and a tip of the pin 267 on the (−Z) side is placed with a slight gap between itself and the axis 266 on the (+Z) side of the axis 266 (for example, at a distance almost equal to the diameter of a metal wire forming the torsion spring 264). In the pulp crushing apparatus of the second preferred embodiment, even if the tip portion of the pressing member 261 on the (−X) side is bounced up clockwise of FIG. 5 by the impact applied to the pulp sheet 9 in crushing it, the movement of the axis 266 toward the (+Z) side is controlled by the pins 267.

In the pulp crushing apparatus of the second preferred embodiment, like in the first preferred embodiment, the pulp crushing mechanism 3 comprises the first crushing mechanism 31 and the second crushing mechanism 32 arranged in parallel to the width direction of the pulp sheet 9 (the Y direction), and the first crushing mechanism 31 and the second crushing mechanism 32 comprise the first crushing cylinder 312 and the second crushing cylinder 322, respectively, for crushing the pulp sheet 9 which goes into the outer peripheral surface. The first crushing cylinder 312 and the second crushing cylinder 322 are provided, being approximate to each other, symmetrically on the (+Y) and (−Y) sides of the center line 91 of the feed line 24 and with rotation of the first crushing cylinder 312 and the second crushing cylinder 322, portions of the pulp sheet 9 on the (+Y) and (−Y) sides are crushed and then the pulp sheet 9 is crushed in whole of the width direction.

The first inclined rotation axis 311 and the second inclined rotation axis 321 are the respective rotation axes of the first crushing cylinder 312 and the second crushing cylinder 322, and each farther end of the inclined rotation axes from the center line 91 is inclined toward the pulp feed mechanism 2. The first inclined rotation axis 311 and the second inclined rotation axis 321 (see FIG. 3) are symmetrical with respect to the center line 91 of the feed line 24, and an angle between each of the inclined rotation axes and the center line 91 is not smaller than 30 degrees and not larger than 60 degrees (45 degrees in this preferred embodiment).

In the pulp crushing apparatus of the second preferred embodiment, like in the first preferred embodiment, when crushing of the pulp sheet 9 goes ahead and the rear end portion of the pulp sheet 9 (the edge on the (+X) side) passes the first upper roller 243 and the first lower roller 244 in the pulp feed mechanism 2 (see FIG. 2), the pulp sheet 9 is automatically moved in the (−X) direction by rotation of the first crushing cylinder 312 and the second crushing cylinder 322.

In the pulp crushing mechanism 3, like in that of the first preferred embodiment, since the first crushing cylinder 312 and the second crushing cylinder 322 are provided so as to be inclined with respect to the direction of feeding the pulp sheet 9, it is possible to reduce the force to pull the pulp sheet 9 in the feeding direction (or the movement speed) as compared with the case where the rotation axis of the crushing cylinder is provided orthogonally to the feeding direction, and it is further possible to suppress an increase in movement speed of the pulp sheet 9 in crushing the near-rearend portion of the pulp sheet 9. This suppresses variation in the amount of pulp sheet 9 to be fed to the pulp crushing mechanism 3 in a unit time also at the near-rearend portion of the pulp sheet 9, and it is thereby possible to increase the amount of crushed pulp to be generated in a unit time and uniformity in quality thereof.

Like in the first preferred embodiment, since the movement speed of the pulp sheet 9 pulled by the first crushing cylinder 312 and the second crushing cylinder 322 is slower than the feeding speed by the pulp feed mechanism 2 (see FIG. 2), the preceding pulp sheet 9 after passing the first upper roller 243 and the first lower roller 244 is fed to the pulp crushing mechanism 3 at the same speed as one before passing these rollers with its rear end portion pushed by the following pulp sheet 9 and crushed therein. Therefore, the pulp sheets 9 can be always fed into the pulp crushing mechanism 3 at a constant speed, and it is thereby possible to always maintain a uniform amount of crushed pulp to be generated in a unit time.

Since the pulp guide part 2411 and the pulp support part 2421 which come into contact with the pulp sheet 9 from the (+Z) and (−Z) sides are provided near the outer peripheral surfaces of the first crushing cylinder 312 and the second crushing cylinder 322, even in crushing the near-rearend portion of the pulp sheet 9, it is possible to prevent the pulp sheet 9 which becomes apart from the first upper roller 243 and the first lower roller 244 from being drawn into the pulp crushing mechanism 3 without being crushed and surely crush the pulp sheet 9 completely.

In the pulp crushing apparatus of the second preferred embodiment, especially, the pulp sheet 9 is pressed onto the pulp support part 2421 by the pulp pressing mechanism 26 very near the first crushing cylinder 312 and the second crushing cylinder 322 which are farthest away from the pulp feed mechanism 2 (in other words, portions to which the near-rearend portion of one pulp sheet 9 is fed last). Therefore, the near-rearend portion of the pulp sheet 9 is held between the pulp pressing mechanism 26 and the pulp support part 2421 until immediately before being fed into the pulp crushing mechanism 3 and it is thereby possible to surely prevent the near-rearend portion of the pulp sheet 9 from being drawn into the pulp crushing mechanism 3 without being crushed. As a result, in the pulp crushing apparatus of the second preferred embodiment, it is possible to surely crush the pulp sheet 9 completely.

In the pulp crushing apparatus of the second preferred embodiment, the pressing member 261 does not necessarily have to have a substantial cylindrical shape but, for example, a polygonal column-like member may be used as the pressing member. In this case, from the viewpoint that the near-rearend portion of the pulp sheet 9 should be surely and completely pressed very near the first crushing cylinder 312 and the second crushing cylinder 322, it is preferable that the tip portion of the pressing member on the (−X) side should have a pointed shape like a polygonal pyramid.

Though the preferred embodiments of the present invention have been discussed above, the present invention is not limited to the above-discussed preferred embodiments, but allows various variations.

For example, the angle between each of the first inclined rotation axis 311 and the second inclined rotation axis 321 and the center line 91 may be an appropriate one which is larger than 0 and smaller than 90 degrees in accordance with the kind and the feeding speed of the pulp sheet 9 to be crushed, the required uniformity in quality of the crushed pulp or the like. From the viewpoint, however, to suppress upsizing of the width of pulp crushing mechanism 3 in the Y direction and increase the feeding speed of the pulp sheet 9 in crushing the near-rearend portion of the pulp sheet 9, it is preferable that the angle should be not smaller than 30 degrees and not larger than 60 degrees.

The first crushing cylinder 312 and the second crushing cylinder 322 do not necessarily have to be arranged symmetrically with respect to the center line 91 of the feed line 24 but, for example, in order to surely crush a portion of the pulp sheet 9 near the center line 91 of the feed line 24, such an arrangement may be adopted so as to shift the positions of these crushing cylinders in the X direction (the feeding direction) and place one (or both) of the crushing cylinders across the center line 91.

Figure 7:
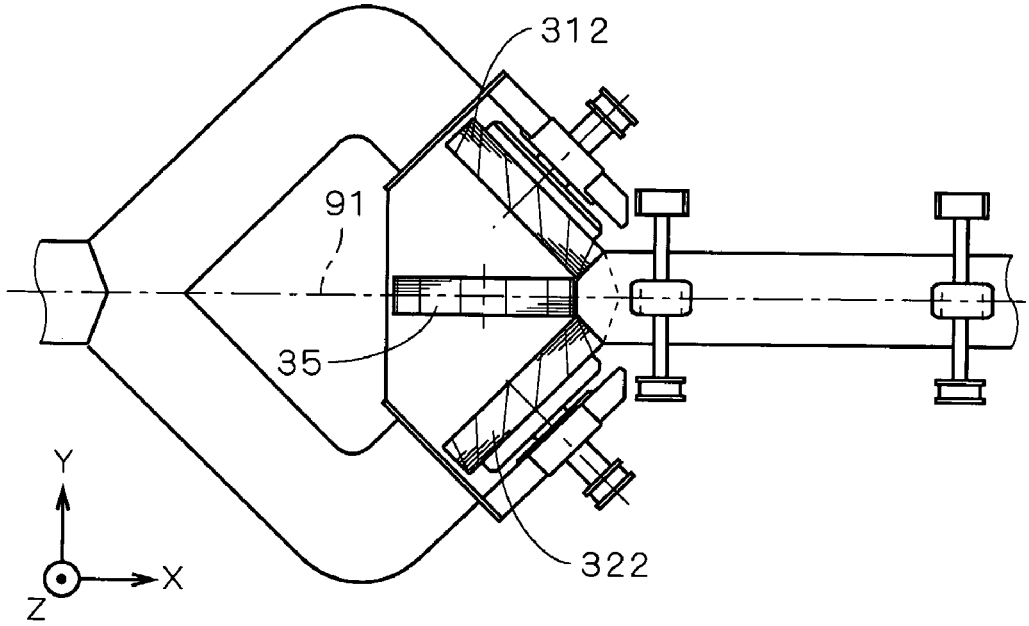
FIG. 7 is a view showing another example of pulp crushing apparatus.

In the pulp crushing mechanism 3, though the pulp sheet 9 can be stably crushed by the first crushing cylinder 312 and the second crushing cylinder 322 provided being approximate to each other, symmetrically with respect to the center line 91 of the feed line 24, an additional crushing cylinder may be provided. As shown in FIG. 7, for example, a third crushing cylinder 35 is provided between the first crushing cylinder 312 and the second crushing cylinder 322 on the center line 91 of the feed line 24, to crush the whole pulp sheet 9 with respect to its width direction by the three crushing cylinders.

In the pulp crushing apparatus, for example, a roll-like pulp sheet wound on the drum may be unreeled and fed into the pulp crushing mechanism 3.

While the invention has been shown and described in detail, the foregoing description is in all aspects illustrative and not restrictive. It is therefore understood that numerous modifications and variations can be devised without departing from the scope of the invention.

The invention claimed is:

1. A pulp crushing apparatus for crushing a pulp sheet for absorbent product, the pulp crush apparatus comprising:

a pulp feed mechanism for feeding a pulp sheet along a predetermined feed line; and a first crushing mechanism and a second crushing mechanism for crushing one side and the other side of the pulp sheet, respectively, the sides of the pulp sheet being parallel to a center line of said feed line, said first crushing mechanism and said second crushing mechanism being arranged in the width direction of the pulp sheet and downstream of said pulp feed mechanism, wherein each of said first crushing mechanism and said second crushing mechanism comprises a crushing cylinder having a substantial tubular shape with an inclined rotation axis as a center, wherein said crushing cylinder is rotatable about said inclined rotation axis to crush said pulp sheet which goes into an outer peripheral surface thereof, said rotation axis being inclined relative to the center line of said feeding line in a direction toward said pulp feed mechanism, and a pulp support part, having a substantial plate shape, for supporting said pulp sheet against rotation of said outer peripheral surface of said crushing surface.

2. The pulp crushing apparatus according to claim 1, wherein said crushing cylinders of said first crushing mechanism and said second crushing mechanism are disposed so as to be approximately symmetrical to each other with respect to said center line of said feed line, and said pulp sheet is crushed in whole in said width direction thereof by said first crushing mechanism and said second crushing mechanism.

3. The pulp crushing apparatus according to claim 1, wherein an angle between said inclined rotation axis of said crushing cylinder and said center line of said feed line is not smaller than 30 degrees and not larger than 60 degrees.

4. The pulp crushing apparatus according to claim 1, wherein said crushing cylinder comprises a plurality of crushing blades arranged along said inclined rotation axis, each of said plurality of crushing blades has a substantial disk shape orthogonal to said inclined rotation axis, and comprises a plurality of teeth provided in its outer periphery at a regular pitch, and said teeth are arranged in a spiral fashion on said outer peripheral surface of said crushing cylinder.

5. The pulp crushing apparatus according to claim 4, wherein said teeth of said crushing cylinder sequentially come into contact with said pulp sheet outwards from the side of said center line of said feed line.

6. The pulp crushing apparatus according to claim 4, wherein said teeth of said first crushing mechanism and said teeth of said second crushing mechanism are provided symmetrically with respect to said center line of said feed line.

7. The pulp crushing apparatus according to claim 1, wherein a near-rear end portion of a preceding pulp sheet after passing said pulp feed mechanism is fed into said first crushing mechanism and said second crushing mechanism with its rear end pushed by a following pulp sheet fed by said pulp feed mechanism in crushing said near-rear end portion of said preceding pulp sheet.

8. The pulp crushing apparatus according to claim 7, wherein each of said first crushing mechanism and said second crushing mechanism further comprises a guide part which comes into contact with said pulp sheet while being opposed to said pulp support part.

9. The pulp crushing apparatus according to claim 1, further comprising a control part for changing a feeding speed at which a pulp sheet is fed by said pulp feed mechanism and controlling a rotation speed of crushing cylinders of said first crushing mechanism and said second crushing mechanism on the basis of said feeding speed.

10. The pulp crushing apparatus according to claim 1, further comprising a stopper provided near said center line of said feed line between said first crushing mechanism and said second crushing mechanism, said stopper being opposed to a front edge of the pulp sheet.

11. The pulp crushing apparatus according to claim 1, further comprising a pressing part provided near said center line of said feed line between said first crushing mechanism and said second crushing mechanism, for pressing a front end portion of the pulp sheet onto said pulp support part.

* * * * *